United States Patent [19]

Bauer

[11] 3,969,012

[45] July 13, 1976

[54] STAMPED CONTACT TIP

[75] Inventor: Anton Ernst Bauer, Neckarsulm, Germany

[73] Assignee: Bunker Ramo Corporation, Oak Brook, Ill.

[22] Filed: Oct. 31, 1974

[21] Appl. No.: 519,420

[52] U.S. Cl. ..... 339/252 P; 113/119

[51] Int. Cl.[2] ..... H01R 13/06

[58] Field of Search ..... 339/252 P; 113/119

[56] References Cited

UNITED STATES PATENTS

| | | | |
|---|---|---|---|
| 1,376,735 | 5/1921 | Stalhane et al. | 339/252 P |
| 2,643,446 | 6/1953 | Matthysse et al. | 113/119 |
| 3,391,567 | 7/1968 | Gregory | 339/252 P |
| 3,693,140 | 9/1972 | Nijman | 339/252 P |

*Primary Examiner*—Joseph H. McGlynn

*Attorney, Agent, or Firm*—D. R. Bair; F. M. Arbuckle

[57] ABSTRACT

The following specification describes a pin contact formed from a stamping with the insertion end of the contact having bevelled end edge surfaces for enabling opposing pin contact external surface ends to engage for providing a closed juncture at the insertion end of the pin contact.

8 Claims, 7 Drawing Figures

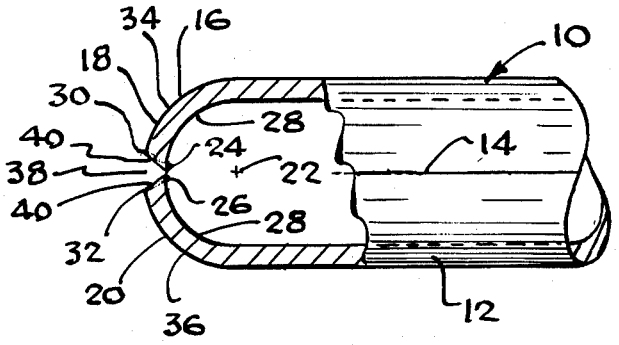
FIG. 1
(PRIOR ART)
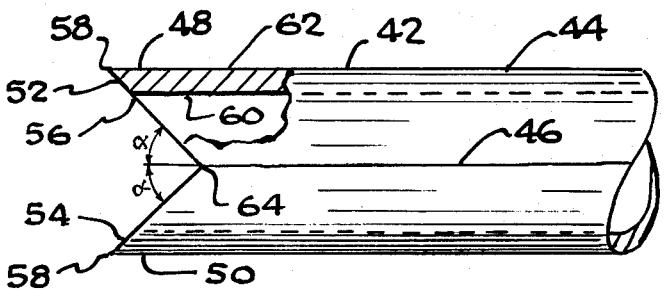
FIG. 2 (PREFINISHED)
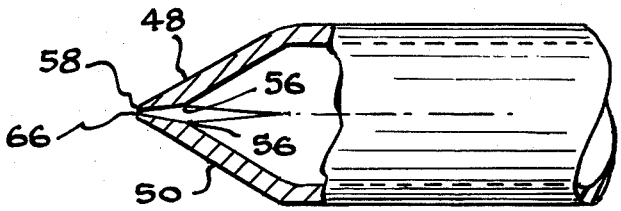
FIG. 3
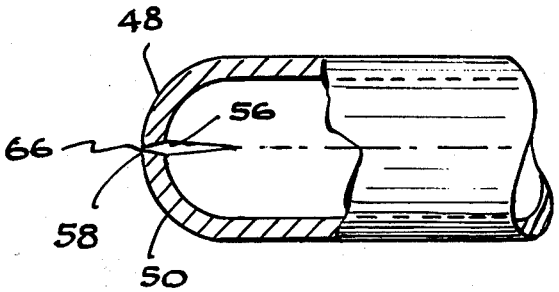
FIG. 4

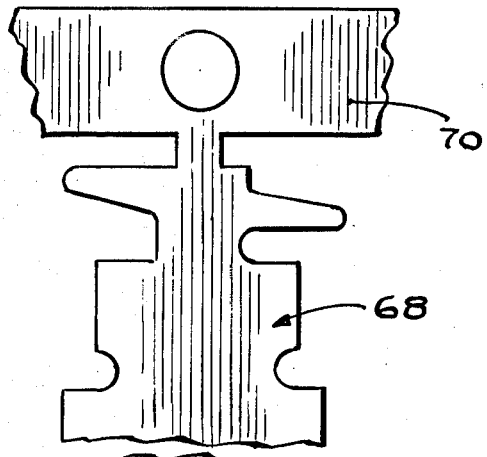
FIG.5
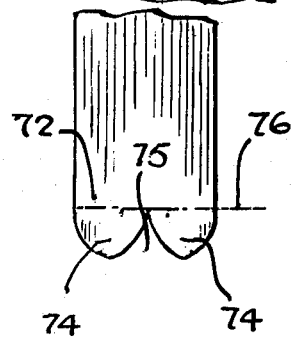
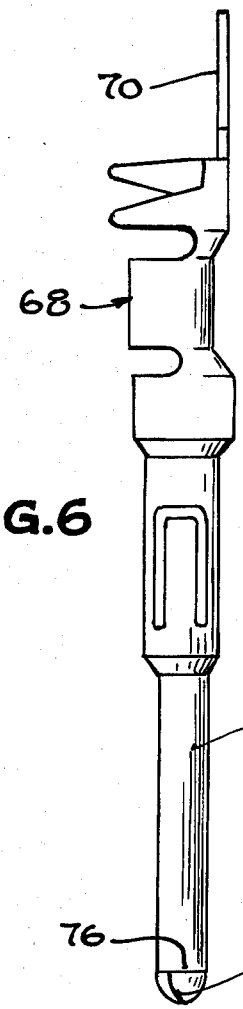
FIG.6
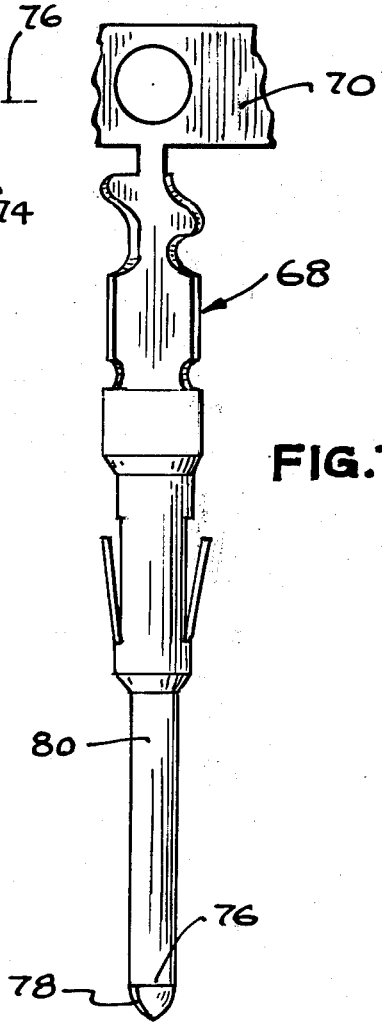
FIG.7

STAMPED CONTACT TIP

BACKGROUND OF THE INVENTION

1. Field of the Invention

This invention relates in general to stamped contacts and more particularly to an improved pin contact formed from a stamping and a method for forming the pin contact.

2. Summary of the Prior Art

Stamped contacts, which are formed by rolling a stamping or preform into a desired shape, are relatively inexpensive and therefore have achieved considerable acceptance. The stampings, when rolled into male or pin contacts, are provided with a closed end for insertion into a female or receptacle contact, however, closing the insertion end requires shearing of portions of the stamping adjacent the end and that the sheared portions be brought into engagement to form seams or junctures from the engaged mating or opposing edges. The seams, however, do not completely close because the internal surface ends of the sheared portions of the stamping meet before the external surface ends when the sheared portions are folded, bent or rotated toward the contact axis to close the insertion end. Therefore, a passageway is provided for the entrance of plating solution resulting in unnecessary plating of the internal contact surface and the deposit of deleterious salt thereon. But importantly, when the pin contact is thereafter inserted in a female or receptacle contact, the open or spaced outer external surface ends of the seam become hooked or engaged with the edges of the female or receptacle contact. The pin contact may then be deformed by further spreading of the edges forming the seam to often render the pin contact useless and/or the female contact is also distorted or deformed.

SUMMARY OF THE INVENTION

The present invention provides a solution to the problem of open seams or junctures at the insertion ends of rolled or stamped pin contacts by providing a bevel on the end edge surface between the ends of the internal and external surfaces of each sheared portion that forms the seam. With the bevel, the inner edges of the seam are spaced in line with the outer edges along the bending plane of the sheared or cutaway portions so that when the end surfaces of the sheared portions are joined, the outer surface ends meet or engage first to insure that the seams are closed.

It is accordingly an object of the present invention to provide an improved pin contact formed from a stamping together with a method of manufacturing the pin contact.

Other objects and features of this invention will become apparent on examination of the following specification and claims together with the drawings.

BRIEF DESCRIPTION OF THE DRAWINGS

FIG. 1 illustrates a typical section of the opposing end edge surfaces of the sheared portions forming the insertion end of a pin contact fabricated from a stamping in accordance with the principles of the prior art.

FIG. 2 illustrates a rolled stamping partially in section and having sheared portions at one end arranged to close to form a pin contact in accordance with the principles of the present invention.

FIGS. 3 and 4 illustrate respective insertion pin contact ends formed in accordance with the present invention.

FIG. 5 illustrates a typical stamping arranged on a web prior to formation of a pin contact, and FIGS. 6 and 7 illustrate respective views of a finished pin contact formed from such stamping with a closed seam or juncture at the insertion end of the contact.

BRIEF DESCRIPTION OF THE INVENTION

In FIG. 1, a portion of a pin contact made in accordance with the principles of the prior art is indicated generally by the reference character 10. The portion 10 includes a shank or body portion 12 rolled from a stamping into a generally hollow cylindrical or annular shape having a closed longitudinal seam 14 extending parallel to the longitudinal axis of the annular shape and having a simulated closed insertion end 16 for insertion into a female or receptacle contact.

The end portion 16 is formed by bending or rotating opposing end portions 18 and 20 of the rolled stamping toward each other and the axis of pin contact about an axis of rotation 22, for example, lying along the longitudinal axis of the annular portion 10 and spaced from the one end 16 toward the other end of the body portion 10 by a distance corresponding to the radius of the portion 10. Therefore, as the opposing end portions 16 and 18 move toward each other, the ends 24 and 26 of the inner surfaces 28 on opposing portions 18 and 20 meet before the ends 30 and 32 of the outer surfaces 34 and 36, since the outer surface ends must move a greater distance than the inner surface ends, before meeting. Therefore, an entrance funnel 38 is formed between the opposed end edge surfaces 40 of the end portions 18 and 20 at the insertion end of the pin contact and these edge surfaces 40 are spaced from each other. The entrance funnel 38 permits the entrance of the plating solution and the edge of a mating receptacle contact, if not exactly aligned with the pin contact, or the entrance of a sharp corner or edge of any other object and the destruction of the contact shape.

To avoid this problem, a contact preform 42 is provided as illustrated in FIG. 2, for example. In preform 42, an annular body or shank portion 44 is provided by rolling a stamping into an annularly shaped wall having a longitudinal seam 46 parallel to the longitudinal axis of the body portion 44. One end of the body portion 44 is sheared to form two opposing sheared end portions or cutaway portions 48 and 50. The end portions 48 and 50 have bevelled end edge surfaces 52 and 54 formed by coining or squeezing the end edge surfaces of the stamping from which the preform 42 is formed with the inner surface end 56 of each edge surface being spaced further in one direction from the contact end than the outer surface end 58 so that the bevel forms an acute angle to the axis of rotation or folding of end portions 48 and 50. Thus the outer surface overlaps or extends beyond the inner surface end by a distance at least equal to the wall thickness of the stamping since the difference in the radius of bending of the inner and outer surfaces is equal to the wall thickness. The result is that the internal surface 60 of the preform 42 is shorter than the external surface 62. Therefore, by choosing a bevel angle dependent on the wall thickness and radius of curvature, when the beveled edge surfaces 52 and 54 are folded or bent inwardly towards each other and about an axis 64 of the preform, the outer surface ends 58 meet, for example, as shown in FIGS. 3 and 4, at least as soon as the inner surface ends 56 since the inner surface is shorter than the outer surface. The outer surface ends 58 therefore form a closed juncture or seam 66 as seen in FIGS. 3 and 4 to prevent the entrance of a foreign object or material. It will be noted from the differences between FIGS. 3 and 4 that the folding of the sheared end portions 48 and 50 need not conform exactly to the radius of the shank.

In the arrangement shown in FIG. 3 the cutaway portions forming the V shaped notch are folded or bent radially to create the semi-conical end having a closed seam 66. To form the spherical shaped insertion end shown in FIG. 4, a spherical die is axially engaged with the cutaway end to fold the two cutaway portions into a generally spherical shape. The shape formed at the insertion end by closure of opposing end portions 48 and 50, as shown in FIGS. 3 and 4, is, of course, determined by the shape of the form dies effectuating the closure but in either event, meeting of the outer surface ends is assured.

In FIG. 5, a stamping 68 attached at one end with other spaced stampings not shown to a web 70, is shown for forming a pin contact having a closed insertion end opposite the one end attached to web 70. The other or insertion end 72 of the stamping 68 is sheared at equispaced positions to provide two equispaced sheared or cutaway portions 74 with each portion 74 separated from the adjacent portion by a respective notch 75. The cutaway portions are joined to the body portion at a position on a fold line 76 spaced near end 72. The contours of each portion 74 are conventionally chosen to facilitate their meeting along a respective seam 78 seen in FIGS. 6 and 7 in response to the folding of the cutaway portions 74 from line 76, after the stamping has been rolled into a generally annular shape of a pin contact 80 as also indicated in FIGS. 6 and 7. The end edge surfaces of cutaway portions 74 are bevelled as indicated in FIG. 2 either when the cutaway portions are formed or after the stamping has been rolled into an annular preform as indicated in FIG. 2. The bevelled end edge surfaces of portions 74 meet as for example shown in FIG. 2 to provide closed insertion end seams 78 for the pin contact as shown in FIGS. 6 and 7. With the insertion end closed, the entrance of foreign objects is, of course, prevented.

The foregoing constitutes a description of an improved contact formed from a stamping and whose inventive concepts are believed set forth in the accompanying claims.

What is claimed is:

1. A pin contact formed from a stamping rolled into an annularly shaped wall with one end adapted to be inserted in a receptacle contact, the improvement comprising:

spaced cutaway portions extending axially from said one end with each cutaway portion having a bevelled end edge surface extending between an outer and an inner annular surface with the outer surface of said annular shape extending axially beyond the end of the inner surface of said annular shape and the ends of the outer surface of said cutaway portions engaging to form a closed seam in response to the folding of said cutaway portions towards each other and the axis of said annular shape.

2. The contact claimed in claim 1 in which said cutaway portions are spaced circumferentially on said wall and folded to form a spherical shape at said one end.

3. The contact claimed in claim 1 in which said cutaway portions are folded from a common line.

4. The contact as claimed in claim 1 in which each bevelled end edge surface has an angle to the longitudinal axis of said annular shape dependent on the thickness of said wall and the radius of the annular shape.

5. The contact as claimed in claim 1 in which the outer surface extends beyond the end of the inner surface by a distance at least equal to the wall thickness of said stamping.

6. A method for forming a pin contact comprising the steps of forming a stamping having an annularly shaped wall with cutaway portions in circumferentially spaced positions extending axially from one end of said annular shape, forming a bevelled edge surface on each cutaway portion extending between an outer and an inner annular surface with the outer surface of each cutaway portion extending axially beyond the end of the inner surface of the respective cutaway portions, and folding said cutaway portions toward the axis of said annular shape to engage the outer surface ends of said cutaway portions and form a closed seam.

7. The method claimed in claim 6 in which the step of folding is further defined as folding said cutaway portions to form a spherical shaped insertion end for said pin contact.

8. The method claimed in claim 6 in which the step of forming a bevelled edge surface is further defined as forming a bevelled edge surface in which the outer surface end of each cutaway portion extends beyond the end of the inner surface end of the respective cutaway portion by a distance at least equal to the thickness of said wall.

* * * * *